US009995179B2

(12) United States Patent
Svihla et al.

(10) Patent No.: US 9,995,179 B2
(45) Date of Patent: Jun. 12, 2018

(54) COMPRESSOR ASSEMBLY FOR TURBOCHARGER BURST CONTAINMENT

(71) Applicant: Electro-Motive Diesel, Inc., LaGrange, IL (US)

(72) Inventors: Gary R. Svihla, Burr Ridge, IL (US); Raji Rexavier, Plainfield, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 398 days.

(21) Appl. No.: 14/573,818

(22) Filed: Dec. 17, 2014

(65) Prior Publication Data

US 2016/0177965 A1 Jun. 23, 2016

(51) Int. Cl.

| | |
|---|---|
| ***F04D 29/16*** | (2006.01) |
| ***F01D 25/24*** | (2006.01) |
| ***F04D 29/28*** | (2006.01) |
| ***F04D 25/02*** | (2006.01) |
| ***F04D 29/10*** | (2006.01) |

(Continued)

(52) U.S. Cl.

CPC ..... *F01D 25/24* (2013.01); *F01D 21/045* (2013.01); *F04D 25/024* (2013.01); *F04D 29/102* (2013.01); *F04D 29/284* (2013.01); *F04D 29/444* (2013.01); *F04D 29/624* (2013.01); *F05D 2220/40* (2013.01)

(58) Field of Classification Search

CPC ..... F01D 25/24; F01D 5/02; F04D 29/624; F04D 29/102; F04D 25/024; F04D 29/444; F04D 29/284; F02B 33/40; F02B 37/00

USPC ..... 60/605.1

See application file for complete search history.

(56) References Cited

U.S. PATENT DOCUMENTS 4,248,566 A * 2/1981 Chapman ..... F04D 27/0215 415/26

4,815,931 A * 3/1989 Linck ..... F01D 1/08 415/121.1

(Continued)

FOREIGN PATENT DOCUMENTS

JP 2015017535 A * 1/2015 ..... F04D 17/12

OTHER PUBLICATIONS

U.S. Appl. No. 14/500,428 of Gary R. Svihla et al. entitled "Compressor Inlet Recirculation System for a Turbocharger" filed Sep. 29, 2014.

*Primary Examiner* — Patrick Maines

(74) *Attorney, Agent, or Firm* — Finnegan, Henderson, Farabow, Garrett & Dunner, LLP

(57) ABSTRACT

A compressor assembly is disclosed. The compressor assembly may have a compressor housing and a compressor impeller disposed within the compressor housing. The compressor impeller may have a hub extending from a hub front end to a hub rear end and an exducer blade disposed on the hub adjacent the hub rear end. The compressor impeller may further include a hub extension extending outward from the hub rear end. The compressor assembly may also have an impeller cap disposed on the hub extension. Further, the compressor assembly may have a windage seal disposed on the impeller cap. The windage seal may be separated from a blade rear surface by an axial gap. In addition, the compressor assembly may have a compressor diffuser disposed within the compressor housing. The compressor diffuser may have a diffuser inner surface separated from an outer rim of the exducer blade by a radial gap.

14 Claims, 2 Drawing Sheets

(51) Int. Cl.

| | |
|---|---|
| ***F04D 29/44*** | (2006.01) |
| ***F04D 29/62*** | (2006.01) |
| ***F01D 21/04*** | (2006.01) |

(56) References Cited

U.S. PATENT DOCUMENTS

| | | | | |
|---|---|---|---|---|
| 4,818,176 | A | 4/1989 | Huether et al. | |
| 4,930,978 | A * | 6/1990 | Khanna | F04D 27/0207 415/58.3 |
| 6,012,901 | A * | 1/2000 | Battig | F01D 5/025 416/244 A |
| 6,050,095 | A * | 4/2000 | Blake | F02B 37/005 60/605.2 |
| 6,168,375 | B1 * | 1/2001 | Larue | F04D 25/04 415/146 |
| 6,183,195 | B1 * | 2/2001 | Tremaine | F04D 29/4213 415/1 |
| 6,293,263 | B1 | 9/2001 | Middlebrook | |
| 6,638,007 | B2 | 10/2003 | Bartholomä et al. | |
| 7,189,052 | B2 | 3/2007 | Jones | |
| 7,478,532 | B2 | 1/2009 | Martin et al. | |
| 8,328,535 | B2 * | 12/2012 | Anschel | F04D 29/444 415/208.4 |
| 8,632,304 | B2 | 1/2014 | Sweetland et al. | |
| 2007/0065276 | A1 * | 3/2007 | Muller | F01D 11/02 415/170.1 |
| 2010/0192570 | A1 * | 8/2010 | Schlienger | F04D 27/0292 60/605.1 |

* cited by examiner

COMPRESSOR ASSEMBLY FOR TURBOCHARGER BURST CONTAINMENT

TECHNICAL FIELD

The present disclosure relates generally to a compressor assembly and, more particularly, to a compressor assembly for turbocharger burst containment.

BACKGROUND

Internal combustion engines, for example, diesel engines, gasoline engines, or natural gas engines employ turbochargers to deliver compressed air for combustion in the engine. A turbocharger compresses air flowing into the engine, helping to force more air into combustion chambers of the engine. The increased supply of air allows for increased fuel combustion in the combustion chambers of the engine, resulting in increased power output from the engine.

A typical turbocharger includes a shaft, a turbine wheel connected to one end of the shaft, a compressor wheel connected to the other end of the shaft, and bearings to support the shaft. Separate housings connected to each other enclose the compressor wheel, the turbine wheel, and the bearings. Exhaust from the engine expands over the turbine wheel and rotates the turbine wheel. The turbine wheel in turn rotates the compressor wheel via the shaft. The compressor wheel receives cool air from the ambient and forces compressed air into combustion chambers of the engine.

Natural inherent material limitations, flaws within the compressor wheel, wear and tear of the compressor stage components, excessive speeds, or debris in the intake air may cause a compressor wheel to fail. To prevent ejection of debris or oil in the event of a compressor wheel failure, turbochargers typically rely on massive housings surrounding the impeller to absorb the tremendous amount of energy released during the failure. The massive housings, however, tend to increase the volume, weight, and cost of the turbocharger. Additionally, although the housings may contain the debris and oil, damage imparted to the housings by the failed compressor wheel components may require expensive and time consuming repairs to the housings, which may place the turbocharger out of service for an extended time period.

U.S. Pat. No. 6,638,007 B2 of Bartholomä et al. that issued on Oct. 28, 2003 ("the '007 patent") discloses a compressor casing that attempts to retain failed compressor components within the casing. In particular, the '007 patent discloses that the compressor casing has an outer spiral casing fastened using a rigid fixing arrangement to a bearing casing of a turbomachine. The '007 patent further discloses that the spiral casing includes an inner cylinder to which a casing insert piece is attached using a flexible attachment arrangement, forming a hollow space between the casing insert piece and the spiral casing. The '007 patent discloses that the flexible attachment arrangement is less secure against fracture as compared to the rigid fixing arrangement. The '007 patent also discloses that the flexible fixing arrangement of the casing insert piece can absorb considerably more kinetic energy than a rigid fixing arrangement. The '007 patent explains that in an emergency, the casing insert piece can move away from the compressor impeller in the axial direction and that the kinetic energy of the compressor impeller pieces can be largely absorbed by conversion into deformation energy and the heat resulting from it. The '007 patent further explains that the residual kinetic energy of the fragments can be absorbed by the casings.

Although the '007 patent discloses a compressor casing designed to contain pieces of a failed impeller, the disclosed casing may still not be optimal. For example, in the event of impeller failure, the casing insert may detach from the spiral casing and move axially outwards, allowing pieces of the impeller to still impact and damage the bearing casing. This may require expensive and time consuming repairs to the bearing casing before the turbomachine can return to service. Damage to the bearing casing may also allow oil to leak from within the turbomachine.

The compressor assembly of the present disclosure solves one or more of the problems set forth above and/or other problems of the prior art.

SUMMARY

In one aspect, the present disclosure is directed to a compressor assembly. The compressor assembly may include a compressor housing. The compressor assembly may also include a compressor impeller disposed within the compressor housing. The compressor impeller may include a hub extending from a hub front end to a hub rear end. The compressor impeller may also include a exducer blade disposed on the hub adjacent the hub rear end. The exducer blade may have a blade rear surface. The compressor impeller may further include a hub extension extending outward from the hub rear end. The compressor assembly may also include an impeller cap disposed on the hub extension. Further, the compressor assembly may include a windage seal disposed on the impeller cap. The windage seal may be separated from the blade rear surface by an axial gap. In addition, the compressor assembly may include a compressor diffuser disposed within the compressor housing. The compressor diffuser may have a diffuser inner surface separated from an outer rim of the exducer blade by a radial gap.

In another aspect, the present disclosure is directed to a turbocharger. The turbocharger may include a turbine housing. The turbocharger may also include a turbine wheel disposed within the turbine housing and configured to be driven by exhaust received from an engine. The turbocharger may further include a compressor housing. The turbocharger may also include a compressor impeller disposed within the compressor housing. The compressor impeller may include a hub extending from a hub front end to a hub rear end. The compressor impeller may also include a exducer blade disposed on the hub adjacent the hub rear end. The exducer blade may have a blade rear surface. The compressor impeller may further include a hub extension extending outward from the hub rear end. The turbocharger may also include an impeller cap disposed on the hub extension. Further, the turbocharger may include a windage seal disposed on the impeller cap. The windage seal may be separated from the blade rear surface by an axial gap. In addition, the turbocharger may include a compressor diffuser disposed within the compressor housing. The compressor diffuser may have a diffuser inner surface separated from an outer rim of the exducer blade by a radial gap. The turbocharger may also include a shaft connecting the impeller cap and the turbine wheel.

DETAILED DESCRIPTION

Figure 1:
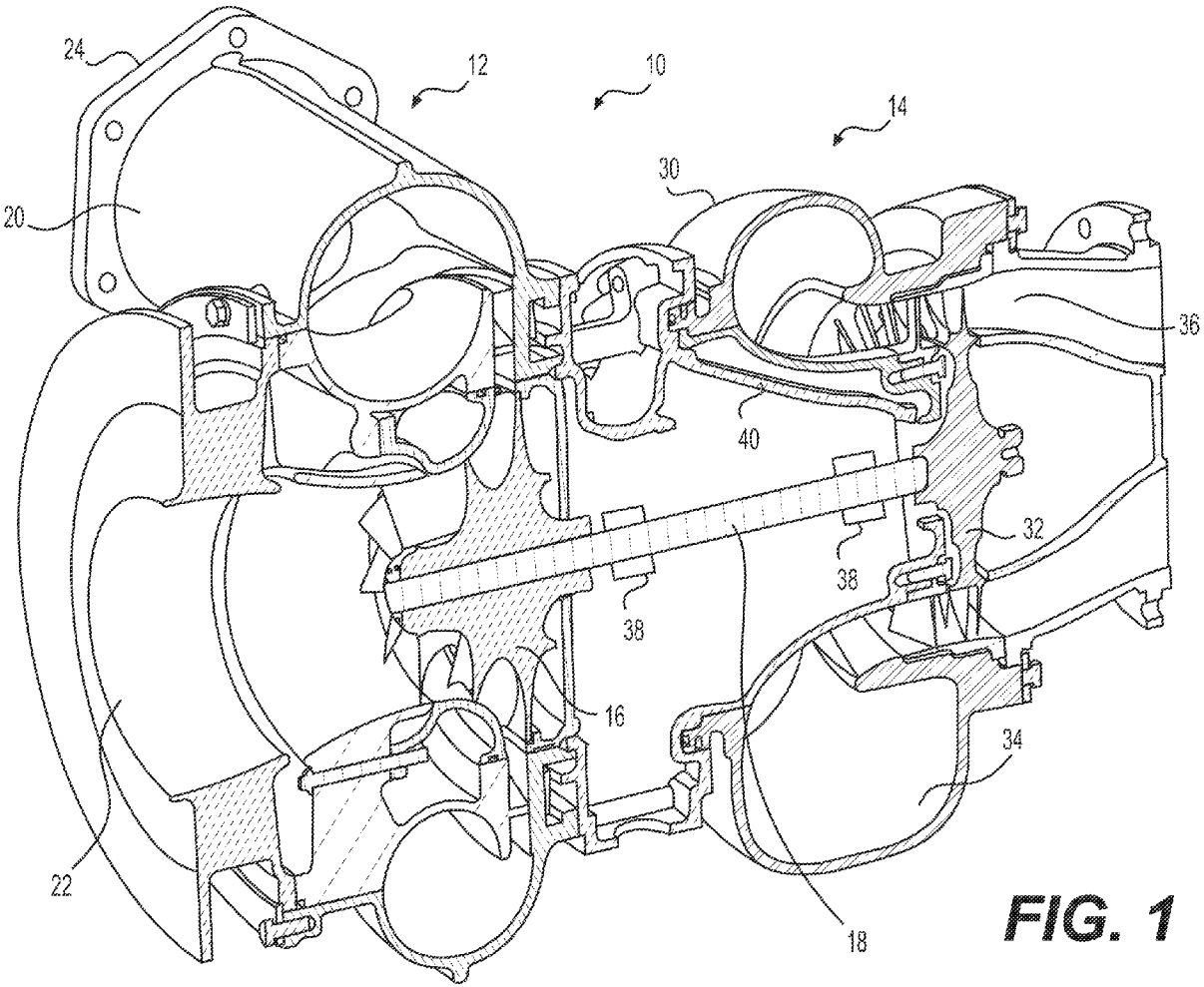
FIG. 1 is a cut-away view of an exemplary disclosed turbocharger.

FIG. 1 illustrates an exemplary embodiment of a turbocharger 10. Turbocharger 10 may be used with an engine (not shown) of a machine that performs some type of operation associated with an industry such as railroad, marine, power generation, mining, construction, farming, or another industry known in the art. As shown in FIG. 1, turbocharger 10 may include compressor stage 12 and turbine stage 14. Compressor stage 12 may embody a fixed geometry compressor impeller 16 attached to shaft 18 and may be configured to compress air received from an ambient to a predetermined pressure level before the air enters the engine for combustion. Air may enter compressor housing 20 via compressor inlet 22 and exit compressor housing 20 via compressor outlet 24. As air moves through compressor stage 12, compressor impeller 16 may increase the pressure of the air which may be directed into the engine.

Turbine stage 14 may include turbine housing 30 and turbine wheel 32, which may be attached to shaft 18. Exhaust gases exiting the engine may enter turbine housing 30 via turbine inlet 34 and exit turbine housing 30 via turbine outlet 36. As the hot exhaust gases move through turbine housing 30 and expand against the blades of turbine wheel 32, turbine wheel 32 may rotate compressor impeller 16 via shaft 18. Bearings 38 may support shaft 18. Bearings 38 may be disposed in bearing housing 40. Although FIG. 1 illustrates only two bearings 38, it is contemplated that turbocharger 10 may include any number of bearings 38.

Figure 2:
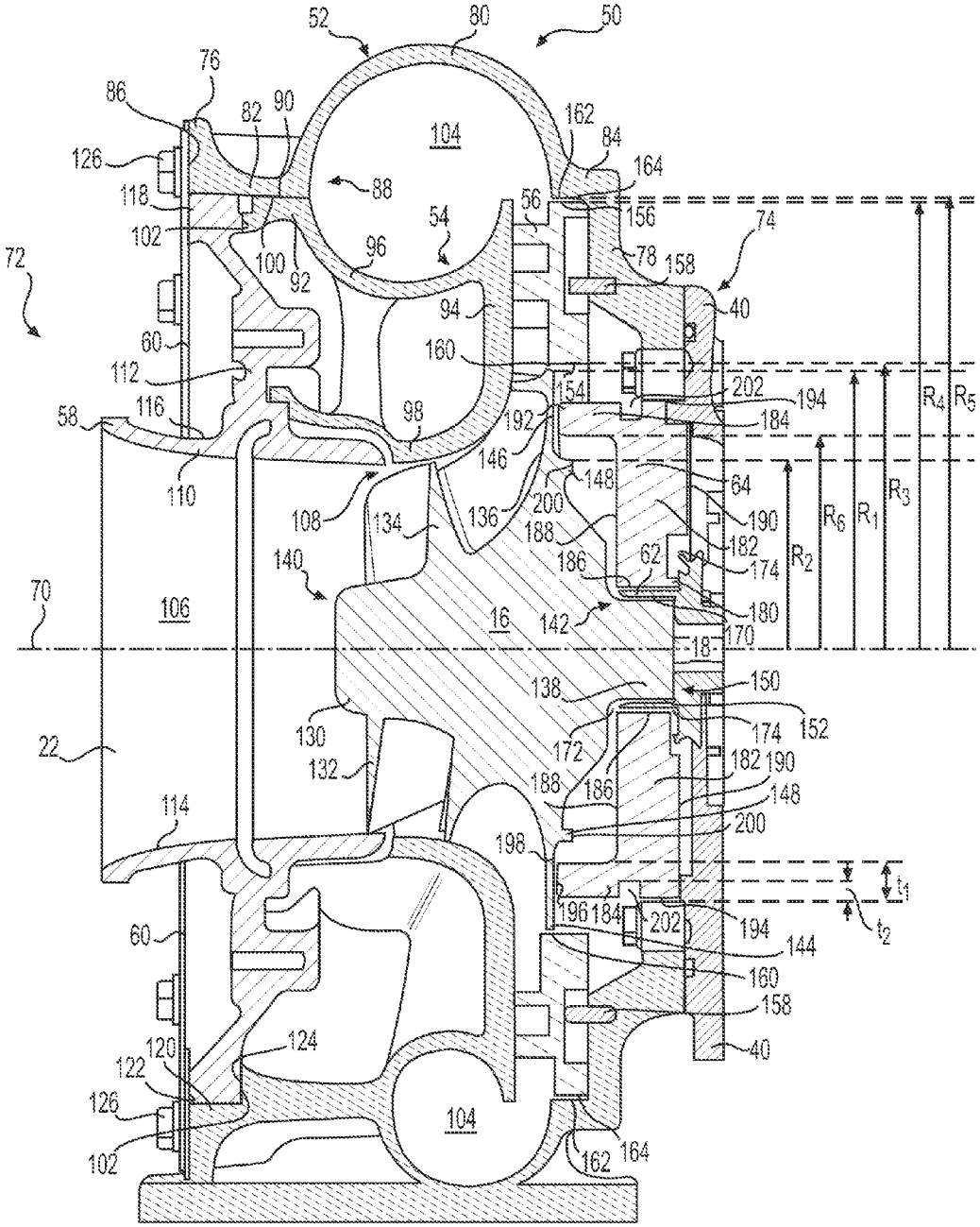
FIG. 2 is a cut-away view of an exemplary disclosed compressor assembly for the turbocharger of FIG. 1.

FIG. 2 illustrates a cut-away view of an exemplary embodiment of a compressor assembly 50 for turbocharger 10. Compressor assembly 50 may include compressor outer volute 52, compressor inner volute 54, compressor diffuser 56, inlet flow guide 58, clamping plate 60, compressor impeller 16, impeller cap 62, and windage seal 64, all of which may be disposed around a rotational axis 70 of compressor assembly 50. Compressor outer volute 52 may extend from adjacent front end 72 of compressor assembly 50 to adjacent rear end 74 of compressor assembly 50. Compressor outer volute 52 may include front wall 76, outer volute rear wall 78, outer volute spiral 80, front extension 82, and rear extension 84. Front wall 76 of compressor outer volute 52 may be disposed adjacent front end 72. Front wall 76 may have a generally flat front face 86, which may be disposed generally orthogonal to rotational axis 70. Outer volute rear wall 78 of compressor outer volute 52 may be disposed adjacent rear end 74. Outer volute rear wall 78 may be axially spaced apart from front wall 76. Outer volute rear wall 78 may be disposed generally orthogonal to rotational axis 70. As illustrated in FIG. 2, outer volute rear wall 78 may be attached to bearing housing 40. Front extension 82 of compressor outer volute 52 may extend from front wall 76 to first distal end 88 disposed between front wall 76 and outer volute rear wall 78. Front extension 82 may include a generally cylindrical bore having an inner surface 90 disposed around rotational axis 70. Outer volute spiral 80 may extend from first distal end 88 to adjacent outer volute rear wall 78. Outer volute spiral 80 may be disposed around rotational axis 70 and may have a generally concave shape. Rear extension 84 may extend from outer volute spiral 80 to outer volute rear wall 78.

Compressor inner volute 54 may include an outer flange 92, inner volute rear wall 94, inner volute spiral 96, and an axial inlet portion 98. Outer flange 92 may have a generally cylindrical outer surface 100, which may be configured to slidingly engage with inner surface 90 of front extension 82 of compressor outer volute 52. Outer flange 92 may also have a generally annular front face 102 disposed generally orthogonal to rotational axis 70. Outer flange 92 may have a length which may be shorter than a length of front extension 82. Inner volute rear wall 94 of compressor inner volute 54 may be disposed between first distal end 88 and outer volute rear wall 78. Inner volute rear wall 94 may be disposed generally orthogonal to rotational axis 70 and may be axially separated from outer volute rear wall 78. Inner volute spiral 96 may extend from first distal end 88 to inner volute rear wall 94. Inner volute spiral 96 may have a generally concave shape and may be disposed opposite outer volute spiral 80. Outer volute spiral 80 and inner volute spiral 96 may form a spiral passageway 104 for air flowing through compressor stage 12. Axial inlet portion 98 of compressor inner volute 54 may extend outward from inner volute rear wall 94 towards front end 72. Axial inlet portion 98 may form a portion of an annular passageway 106 that may direct air to compressor impeller 16.

Inlet flow guide 58 may extend from adjacent front end 72 to second distal end 108 disposed between first distal end 88 and inner volute rear wall 94. Inlet flow guide 58 may include an inlet duct portion 110 and a web 112. Inlet duct portion 110 may have an inner duct surface 114, which may form a portion of annular passageway 104 having an approximately frusto-conical shape. Inlet duct portion 110 may engage with axial inlet portion 98 to form compressor inlet 22 for directing air to compressor impeller 16. Web 112 may extend generally radially outwards from an outer duct surface 116 of inlet duct portion 110. Web 112 may include a generally annular attachment portion 118. Attachment portion 118 may have a generally cylindrical attachment outer surface 120, which may slidingly engage with inner surface 90 of front extension 82. Attachment portion 118 may also have an attachment front face 122 disposed adjacent front end 74 and an attachment rear face 124 disposed opposite attachment front face 122. As illustrated in FIG. 2, attachment rear face 124 of attachment portion 118 may abut front face 102 of compressor inner volute 54.

Clamping plate 60 may have a generally annular shape and may abut front wall 76 and attachment front face 122. Clamping plate 60 may be attached to compressor outer volute 52 via one or more fasteners 126, which may allow clamping plate 60 to hold inlet flow guide 58 and compressor inner volute 54 within compressor outer volute 52. Clamping plate 60 may be a thin sheet of metal. It is contemplated, however, that clamping plate may be made of any suitably ductile material. A thickness of clamping plate 60 may be selected to allow clamping plate 60 to deflect without experiencing mechanical failure when subjected to loads during the operation of compressor stage 12 or in the event of a failure of compressor impeller 16. Although FIG. 2 illustrates one clamping plate 60, it is contemplated that compressor assembly 50 may have any number of clamping plates 60.

Compressor impeller 16 may be disposed within compressor housing 20 formed by compressor outer volute 52, compressor inner volute 54, and inlet flow guide 58. Compressor impeller 16 may include hub 130 and one or more front blades 132, center blades 134, and exducer blades 136, and hub extension 138. Hub 130 may extend from hub front end 140 to hub rear end 142. Hub front end 140 may be disposed adjacent second distal end 108. Front, center, and exducer blades 132, 134, 136 may be disposed in axially separated rows on hub 130. As illustrated in FIG. 2, front blades 132 may be disposed adjacent hub front end 140 and exducer blades 136 may be disposed nearer hub rear end 142 relative to hub front end 140. Center blades 134 may be disposed between front blades 132 and exducer blades 136. Although FIG. 2 illustrates only one row each of front blades 132, center blades 134, and exducer blades 136, it is contemplated that compressor impeller may include any number of rows of blades 132, 134, 136.

An outer rim 144 of exducer blade 136 may be disposed between inner volute rear wall 94 and outer volute rear wall 78. Outer rim 144 of exducer blade 136 may have a radius "$R_1$." Exducer blade 136 may also have a blade rear surface 146. Balancing ring 148 may be disposed on blade rear surface 146 of exducer blade 136. Balancing ring 148 may be a generally annular projection, which may project outward from blade rear surface 146 towards rear end 74. Balancing ring 148 may have an outer radius "$R_2$" that may be smaller than radius R1 of outer rim 144 of exducer blade 136.

Hub extension 138 may project outwards from hub 130 towards rear end 74. Hub extension 138 may extend from adjacent hub rear end 142 to hub extension end 150 which may be disposed between hub rear end 142 and rear end 74. Hub extension 138 may have a radius smaller than outer radii of front, center, or exducer blades 132, 134, 136. Hub extension 138 may have a generally cylindrically shaped hub extension outer surface 152. Hub 130, front blades 132, center blades 134, exducer blades 136, balancing ring 148, and hub extension 138 may form one integrated structure. In one exemplary embodiment, hub 130, front blades 132, center blades 134, exducer blades 136, balancing ring 148, and hub extension 138 may constitute a single machined forging or casting.

Compressor diffuser 56 may be a generally annular structure disposed between outer volute rear wall 78 and inner volute rear wall 94. Compressor diffuser 56 may have a generally cylindrical diffuser inner surface 154 and a generally cylindrical diffuser outer surface 156. Diffuser inner surface 154 may have a radius "$R_3$" and diffuser outer surface 156 may have a radius "$R_4$," which may be larger than radius $R_3$. Compressor diffuser 56 may be centered on compressor outer volute 52 via one or more alignment pins 158. In one exemplary embodiment as shown in FIG. 2, radius $R_3$ of diffuser inner surface 154 may be larger than radius $R_1$ of outer rim 144, forming first radial gap 160 between exducer blade 136 and compressor diffuser 56. As also illustrated in the exemplary embodiment of FIG. 2, radius $R_4$ of diffuser outer surface 156 may be smaller than a radius "$R_5$" of rear extension inner surface 162 forming second radial gap 164 between compressor diffuser 56 and compressor outer volute 52.

Impeller cap 62 may be disposed on hub extension 138. Impeller cap 62 may be connected to shaft 18. Impeller cap 62 may include a cap bore 170 extending from cap front end 172 to hub extension end 150. As illustrated in FIG. 2, cap front end 172 may be axially separated from hub rear end 142. Cap bore 170 may have a diameter such that impeller cap 62 may be disposed around hub extension outer surface 152. In one exemplary embodiment, impeller cap 62 may engage with hub extension outer surface 152 via an interference fit. In another exemplary embodiment, impeller cap 62 may engage with hub extension outer surface 152 via a clearance fit. Impeller cap may also have a cap outer surface 174.

Windage seal 64 may be disposed between hub rear end 142 and hub extension end 150. Windage seal 64 may include a seal hub 180, seal web 182, and a seal shield 184. Seal hub 180 may have a windage seal bore 186, which may be disposed around cap outer surface 174 of impeller cap 62. Windage seal bore 186 may be separated from cap outer surface 174 by a labyrinth seal (not shown). Seal web 182 may extend radially outward from seal hub 180. Seal web 182 may have a web front surface 188 and a web rear surface 190. Seal shield 184 may be disposed near an outer periphery of seal web 182. Seal shield 184 may project outwards from web front surface 188 towards front end 72 to shield front end 192. Seal Web 182 and seal shield 184 may share a generally cylindrical web outer surface 194 extending between shield front end 192 and web rear surface 190. Seal shield 184 may also have a shield front face 196 disposed adjacent shield front end 192. Shield front face 196 may have a generally annular shape and may be disposed generally orthogonal to rotational axis 70. Shield front face 196 may be axially spaced apart from blade rear surface 146 by axial gap 198. In one exemplary embodiment as illustrated in FIG. 2, seal shield 184 may overhang balancing ring 148 so that a distance of shield front face 196 from blade rear surface 146 may be smaller than a distance of balancing ring end 200 from blade rear surface 146. Seal shield 184 may have a thickness "$t_1$" in the radial direction. Seal shield may also have an inner radius "$R_6$," which may be larger than a radius $R_2$ of balancing ring 148 and smaller than a radius $R_1$ of outer rim 144 of exducer blade 136. Seal shield 184 may also include a groove 202 disposed on shield outer surface 194. Groove 202 may be a circumferential groove disposed nearer web front face 188 as compared to web rear face 190. Groove 202 may have a radial depth "$t_2$," which may be smaller than $t_1$.

INDUSTRIAL APPLICABILITY

The disclosed compressor assembly 50 may be implemented to ensure that debris from a failed compressor impeller 16 may be contained within compressor housing 20, while ensuring that oil from bearing housing 40 does not leak out of turbocharger 10. In particular, compressor assembly 50 may employ a plurality of obstructions to dissipate the energy released during failure of compressor impeller 16 to prevent rupture of compressor housing 20 and bearing housing 40. Compressor assembly 50 may also prevent penetration of bearing housing 40 by fragments of compressor impeller 16, resulting from failure of compressor impeller 16, to ensure that oil from within bearing housing 40 does not leak out of turbocharger 10.

Referring to FIG. 2, when compressor impeller 16 fails during operation of turbocharger 10, compressor impeller 16 may fracture adjacent hub rear end 142. For example, compressor impeller 16 may fracture between hub rear end 142 and cap front end 172. Front and center blades 132, 134 may come into contact with compressor inner volute 54, which may push compressor inner volute 54 radially and axially outward. Outer rim 144 of exducer blade 136 may be displaced radially through first radial gap 160 and may come into contact with diffuser inner surface 154 of compressor diffuser 56, pushing compressor diffuser 56 towards rear extension inner surface 162. Second radial gap 164 helps ensure that energy released by failure of compressor impeller 16 is absorbed by compressor diffuser 56 before compressor diffuser comes into contact with rear extension inner surface 162. The one or more clamping plates 60 may also deflect, helping compressor outer volute 52 to absorb the kinetic energy imparted to compressor outer volute 52 by fragments of compressor impeller 16.

Further, as exducer blades 136 are propelled radially outward, balancing ring 148 may come into contact with seal shield 184. Because seal shield 184 overhangs balancing ring 148, an impact of balancing ring 148 with seal shield 184 may cause seal shield 184 to fracture adjacent groove 202. Fragments of exducer blades 136 and seal shield 184 may be driven into contact with outer volute rear wall 78 causing compressor outer volute 52 to absorb the kinetic energy of the fragments. By allowing seal shield 184 to fracture adjacent groove 202, compressor assembly 50 may ensure that seal web 182 remains unruptured, helping to ensure that oil from within bearing housing 40 remains within bearing housing 40 and does not leak out of turbocharger 10. Thus, by focusing the trajectory of the impeller fragments towards seal shield 184 and compressor diffuser 56, compressor assembly 50 may help isolate bearing housing 40 from mechanical damage. Moreover, by maintaining first and second radial gaps 160, 164, compressor assembly 50 may help ensure that some of the energy released due to failure of compressor impeller 16 is absorbed by compressor diffuser 56 instead of requiring compressor outer volute 52 to absorb a majority of the energy. This may also help to limit a thickness of compressor outer volute 52 necessary to contain fragments of compressor impeller 16 within compressor housing 20, which in turn may allow compressor housing to be lighter and less expensive. Further, by using a series of obstructions in the form of balancing ring 148, seal shield 184 and compressor diffuser 56 to absorb the kinetic energy of the impeller fragments, compressor assembly 50 may also help reduce an amount of damage caused to compressor outer volute 52 and bearing housing 40.

It will be apparent to those skilled in the art that various modifications and variations can be made to the disclosed compressor assembly. Other embodiments will be apparent to those skilled in the art from consideration of the specification and practice of the disclosed compressor assembly. It is intended that the specification and examples be considered as exemplary only, with a true scope being indicated by the following claims and their equivalents.

What is claimed is:

1. A compressor assembly, comprising:
a compressor housing;
a compressor impeller disposed within the compressor housing, the compressor impeller including:
a hub extending from a hub front end to a hub rear end;
an exducer blade disposed on the hub adjacent the hub rear end, the exducer blade having a blade rear surface; and
a hub extension extending outward from the hub rear end;
an impeller cap disposed on the hub extension;
a windage seal including:
a windage seal bore,
an outer surface of the impeller cap being disposed within the windage seal bore,
a seal hub,
a seal web extending generally radially from the seal hub, and
a seal shield extending generally axially towards the blade rear surface from a radially outermost portion of the seal web, the seal shield including a shield front face disposed opposite to and axially spaced apart from the blade rear surface by a first axial distance; and
a compressor diffuser disposed within the compressor housing, the compressor diffuser having a diffuser inner surface separated from an outer rim of the exducer blade by a radial gap, wherein
the exducer blade has a balancing ring projecting outwards from the blade rear surface, the balancing ring having an balancing ring end,
the seal shield has an inner radius larger than a radius of the balancing ring, and
the first axial distance is smaller than a second axial distance between the balancing ring end and the blade rear surface.

2. The compressor assembly of claim 1, wherein the compressor housing includes:
a compressor outer volute configured to be connected to a bearing housing;
a compressor inner volute; and
an inlet flow guide attached to the compressor inner volute and the compressor outer volute and configured to direct air into the compressor impeller.

3. The compressor assembly of claim 2, wherein
the compressor outer volute includes an outer volute rear wall,
the compressor inner volute includes an inner volute rear wall, and
the compressor diffuser is disposed between the outer volute rear wall and the inner volute rear wall.

4. The compressor assembly of claim 3, wherein
the radial gap is a first radial gap,
the compressor outer volute includes an extension having an inner surface, and
the compressor diffuser is separated from the inner surface by a second radial gap.

5. The compressor assembly of claim 3, wherein the compressor diffuser is centered on the compressor outer volute by a plurality of alignment pins disposed circumferentially relative to a rotational axis of the compressor assembly.

6. The compressor assembly of claim 1, wherein
the seal web and the seal shield have an outer surface, and
the windage seal includes a groove disposed on the outer surface.

7. The compressor assembly of claim 6, wherein
the seal web has a web front face and a web rear face opposite to the web front face,
the seal shield extends outwards from the web front face, and
the groove is disposed nearer the web front face as compared to the web rear face.

8. A turbocharger, comprising:
a turbine housing;
a turbine wheel disposed within the turbine housing and configured to be driven by exhaust received from an engine;
a compressor housing;
a compressor impeller disposed within the compressor housing, the compressor impeller including:
a hub extending from a hub front end to a hub rear end;
an exducer blade disposed on the hub adjacent the hub rear end, the exducer blade having a blade rear surface; and
a hub extension extending outward from the hub rear end;
an impeller cap disposed on the hub extension;
a windage seal including:
a windage seal bore,
an outer surface of the impeller cap being disposed within the windage seal bore,
a seal hub, a seal web extending generally radially from the seal hub, and a seal shield extending generally axially towards the blade rear surface from a radially outermost portion of the seal web, the seal shield including a shield front face disposed opposite to and axially spaced apart from the blade rear surface by a first axial distance;

a compressor diffuser disposed within the compressor housing, the compressor diffuser having a diffuser inner surface separated from an outer rim of the exducer blade by a radial gap; and a shaft connecting the impeller cap and the turbine wheel, wherein the exducer blade has a balancing ring projecting outwards from the blade rear surface, the balancing ring having an balancing ring end, the seal shield has an inner radius larger than a radius of the balancing ring, and the first axial distance is smaller than a second axial distance between the balancing ring end and the blade rear surface.

9. The turbocharger of claim 8, wherein the compressor housing includes:

a compressor outer volute configured to be connected to a bearing housing;

a compressor inner volute; and an inlet flow guide attached to the compressor inner volute and the compressor outer volute and configured to direct air into the compressor impeller.

10. The turbocharger of claim 9, wherein the compressor outer volute includes an outer volute rear wall, the compressor inner volute includes an inner volute rear wall, and the compressor diffuser is disposed between the outer volute rear wall and the inner volute rear wall.

11. The turbocharger of claim 10, wherein the radial gap is a first radial gap, the compressor outer volute includes an extension having an inner surface, and the compressor diffuser is separated from the inner surface by a second radial gap.

12. The turbocharger of claim 10, wherein the compressor diffuser is centered on the compressor outer volute by a plurality of alignment pins disposed circumferentially relative to a rotational axis of the turbocharger.

13. The turbocharger of claim 8, wherein the seal web and the seal shield have an outer surface, and the windage seal includes a groove disposed on the outer surface.

14. The turbocharger of claim 13, wherein the seal web has a web front face and a web rear face opposite to the web front face, the seal shield extends outwards from the web front face, and the groove is disposed nearer the web front face as compared to the web rear face.

* * * * *